US011712110B2

(12) United States Patent
Wolf

(10) Patent No.: US 11,712,110 B2
(45) **Date of Patent: *Aug. 1, 2023**

(54) ELECTRICAL OPERATING PANEL

(71) Applicant: LINAK A/S, Nordborg (DK)

(72) Inventor: Jesper Madsen Wolf, Broager (DK)

(73) Assignee: Linak A/S, Nordborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/535,237

(22) Filed: Nov. 24, 2021

(65) Prior Publication Data

US 2022/0079330 A1 Mar. 17, 2022

Related U.S. Application Data

(63) Continuation of application No. 16/499,550, filed as application No. PCT/DK2018/000014 on May 15, 2018, now Pat. No. 11,206,919.

(30) Foreign Application Priority Data

May 15, 2018 (DK) ..... PA 2017 00304

(51) Int. Cl.

| | |
|---|---|
| ***A47B 9/00*** | (2006.01) |
| ***H01H 23/14*** | (2006.01) |
| ***H01H 23/16*** | (2006.01) |

(52) U.S. Cl.

CPC ..... *A47B 9/00* (2013.01); *H01H 23/143* (2013.01); *H01H 23/162* (2013.01); *A47B 2200/0061* (2013.01); *A47B 2200/0062* (2013.01)

(58) Field of Classification Search

CPC ..... A47B 9/00; A47B 2200/0061; A47B 2200/0062; H01H 23/143; H01H 23/162

See application file for complete search history.

(56) References Cited

U.S. PATENT DOCUMENTS

| | | | |
|---|---|---|---|
| 3,080,835 | A | 3/1963 | Vito |
| 3,839,614 | A | 10/1974 | Saganowski et al. |

(Continued)

FOREIGN PATENT DOCUMENTS

| | | | |
|---|---|---|---|
| DE | 196 04 329 | A1 | 8/1997 |
| DE | 298 18 567 | U1 | 1/1999 |

(Continued)

*Primary Examiner* — Daniel J Rohrhoff

(74) *Attorney, Agent, or Firm* — Dykema Gossett PLLC

(57) ABSTRACT

Electrical operating unit comprising a first and a second part, where the two parts can be mutually adjusted. The Operating unit (1) comprises a first part constructed as a housing (2), which contains the electric equipment with at least one electric switch and a second part constructed as a mounting unit (3) for the first part. The two parts are interconnected about a shaft (17), or pivot, so they can rotate mutually. When the operating unit is mounted the housing (2) will assume a first position, an initial position. By pressing the housing (2) it rotates about the shaft (17) and is brought into a second position, an activation position, where the switch (es) is/are activated in that they are pressed against the second part (3). With this embodiment of the operating unit the piece of furniture can be adjusted in either direction by pressing the housing (2). The housing (2), besides from functioning as a switch, can also be equipped with other switches and displays.

13 Claims, 4 Drawing Sheets

(56) References Cited

U.S. PATENT DOCUMENTS

| | | | | |
|---|---|---|---|---|
| 5,050,941 | A | 9/1991 | Dahnert et al. | |
| 5,323,695 | A | 6/1994 | Borgman et al. | |
| 5,526,756 | A | 6/1996 | Watson | |
| 5,588,377 | A | 12/1996 | Fahmian | |
| 6,038,986 | A | 3/2000 | Ransil et al. | |
| 6,360,675 | B1 | 3/2002 | Jones | |
| 6,595,144 | B1 * | 7/2003 | Doyle | A47B 9/00 248/188.4 |
| 7,078,640 | B2 | 7/2006 | Miyake et al. | |
| D794,581 | S | 8/2017 | Lin | |
| D833,981 | S | 11/2018 | Seal et al. | |
| 10,602,839 | B2 | 3/2020 | Seal et al. | |
| 11,206,919 | B2 * | 12/2021 | Wolf | H01H 23/30 |
| 2005/0199520 | A1 * | 9/2005 | Nielsen | A47B 9/00 206/326 |
| 2006/0061315 | A1 | 3/2006 | Schmidt et al. | |
| 2009/0078167 | A1 | 3/2009 | Ellegaard | |
| 2012/0241301 | A1 * | 9/2012 | Chiba | H01H 23/30 200/511 |
| 2013/0199419 | A1 | 8/2013 | Hjelm | |
| 2013/0233684 | A1 * | 9/2013 | Kato | H01H 23/08 200/339 |
| 2014/0096706 | A1 | 4/2014 | Labrosse et al. | |
| 2015/0047538 | A1 * | 2/2015 | Ergun | A47B 9/02 248/188.5 |
| 2016/0128467 | A1 | 5/2016 | Sigal et al. | |
| 2017/0047180 | A1 * | 2/2017 | Wang | H01H 37/76 |
| 2017/0055720 | A1 | 3/2017 | Lin et al. | |
| 2017/0354244 | A1 | 12/2017 | Lee et al. | |
| 2018/0168335 | A1 * | 6/2018 | Seal | A47B 9/20 |
| 2020/0168413 | A1 * | 5/2020 | Kang | H01H 23/143 |

FOREIGN PATENT DOCUMENTS

| | | | |
|---|---|---|---|
| DE | 102016115244 | A1 | 3/2017 |
| EP | 0922410 | A2 | 6/1999 |
| EP | 1470766 | A1 | 10/2004 |
| EP | 2141718 | A1 | 1/2010 |
| JP | 2003257287 | A | 9/2003 |
| JP | 2006155969 | A | 6/2006 |
| WO | 2003093619 | A1 | 11/2003 |
| WO | 2004040169 | A1 | 5/2004 |
| WO | 2009033486 | A1 | 3/2009 |
| WO | 2010054656 | A1 | 5/2010 |

* cited by examiner

ELECTRICAL OPERATING PANEL

PRIORITY

This patent application claims priority from U.S. patent application Ser. No. 16/499,550, filed Sep. 30, 2019 (the '550 application), which is a national stage filing based on international application PCT/DK2018/000014, filed May 15, 2018 (the '014 application), and published in English on Nov. 22, 2018 under international publication no. WO 2018/210385 A1, which claims priority to Denmark (DK) patent application no. PA 2017 00304, filed May 15, 2017 (the '304 application). The '550 application, the '014 application and the '304 application are all hereby incorporated by reference as though fully set forth herein.

BACKGROUND

The present invention relates to an electrical operating panel especially for furniture, comprising at least one electric switch as well as a first part and a second part, where the two parts are interconnected about an axis such that they can rotate relative to each other.

Sit/stand desks where the height, more precisely the height of the table top above floor level, is adjusted by means of electric motor driven lifting columns can be adjusted by means of an operating panel or via a computer such as a PC (cf. e.g. EP 0 922 410 A2 to Svenska Kennab), laptop, telephone etc. It has however proven that the preferred means of adjustment is a separate operating panel allowing the table to be operated independent of computers. Examples of such operating panels are known from U.S. Pat. No. 5,323,695 to Borgman et al., which discloses an operating panel as a separate unit positioned on the table top, DE 298 18 567 to Vibradorm GmbH discloses an operating unit where the keyboard part is removably located in a mounting part secured at the edge of a table top. A more distinctively designed operating unit is disclosed in EP 1 470 766 A1 to Walter Koch mounted over an edge of the table top with a foil switch on the top side and underside of the table top, respectively. WO 03/093619 A1 to Linak A/S discloses an operating unit as described in the preamble of claim 1 comprising a first part with a keyboard and a second part by means of which the operating unit among other things can be mounted, and where the two parts are mutually hinged. The operating unit is intended for mounting underneath the table top such that the keyboard in its entirety or partly protrudes out in front of the edge of the table with the keyboard facing upwards such that it can be operated from above. A technical challenge is the mutual hinging of the two parts such that the part with the keyboard can assume various angular positions according to the wishes of the user and still maintain its position when the user operates the keys on the keyboard. Another challenge is the electric equipment, which is so space-consuming that it in addition to in the keyboard part also takes up space in the other part, which per se is inexpedient when the electric equipment will have to be divided into two parts, and further an electrical connection between the two parts must be established, a connection which should take the angular position between the two parts into account.

SUMMARY OF THE INVENTION

The purpose of the invention is to provide an electrical operating unit, which overcomes one or more of the mentioned disadvantages and further has a simple construction, is user-friendly and easy to mount.

This is achieved according to the invention as stated in claim 1 with an electrical operating unit, which comprises a first part with at least one electrical switch and a second part, where the two parts are interconnected about a shaft, allowing them to rotate mutually, where the first part is constructed as a housing and the second part is constructed as a mounting unit, interconnected with the first part (in the following known as the housing) such that the housing can assume a first position, an initial position, from which the housing by rotating about the shaft can be brought into a second position, an activation position, whereby the switch is activated. The operating unit is thus clearly divided, whereby the housing can contain the entire electric equipment, and a mounting unit, which serves for the mounting of the operating unit. In its simplest embodiment the operating unit can simply consist of the mounting unit and the housing, where the housing when tilted about the shaft activates the electrical switch(es). When more operating possibilities are desired, the embodiment also allows for a better possibility to integrate various operating components such as extra switches, displays and touch panels in the operating unit. In an embodiment the electric equipment among other things comprises a printed circuit board located in the housing. The printed circuit board can in principle contain the entire necessary equipment.

In an embodiment, the housing is constructed as two parts, an upper part comprising a round-going side wall and a bottom part also with a round-going side wall, where the contour of the two side walls corresponds to each other allowing them to be joined together, e.g. by welding or gluing, making the joint dust and water proof. This simplifies as a rule the mounting of the electronics, as it generally can be gathered in one of the parts, e.g. the bottom part, and the joint between the bottom part and the upper part can be made dust and water-proof e.g. by gluing or welding. The edges can in that connection e.g. be constructed with tongue and groove or be designed with corresponding steps, which fit together in the joining.

In an embodiment, the upper part of the housing is furnished with a recess for the mounting unit contrary to an embodiment where the recess continues all the way through the entire housing. In this embodiment the bottom part is unbroken. This allows for a simple mounting of the mounting unit. As mentioned above all the electronics can e.g. be gathered in the bottom part of the housing while the mounting unit can be mounted in the upper part, independent of the electronics.

In an embodiment, the recess is restricted by a side wall, which protrudes a distance up from the housing, and possibly also a distance into the housing. Thus, if not entirely prevented, it is still made difficult for dirt and liquid to enter into the housing. For instance, in case fluid is spilled on the table top and it runs over the edge, the fluid tends to seek under the table top, where it can drip or run onto the top side of the housing. The side wall will thus prevent the fluid from running into the housing.

In an embodiment, the mounting part is constructed as a flat box-shaped block with round-going sides and a plane bottom, and where the inside of the block can be furnished with a pattern of stiffening ribs. This is a simple and yet strong structure. The top side of the mounting part can be open, which simplifies the manufacturing of the mounting part. During mounting, the upper part will, with its top side, rest against the surface on which the mounting part is secured, and the top side will thus be closed.

In an embodiment, the side of the mounting element which faces towards or protrudes into the housing is furnished with a pin for activation of the electrical switch(es). When the housing is tilted about the shaft, the electrical switch will get into contact with the pin, by which the switch is activated. When the housing is released, this will rotate back, and the switch thus releases the pin. Typically, there will be a pin for each electrical switch, but one or more pins can also operate two or more electrical switches. This can e.g. be a precautionary measure or for activating more functions at the same time. In that case, a pin can also be constructed with a small setback such that one function is activated first and another function thereafter, as the after-migration in the first switch is utilized. It is understood, in that case that the migration of the pin, after it has activated the first switch, must be adapted such that the continued migration for activation of the next switch does not result in damage or overload of the first switch.

The mounting element can be secured in numerous ways, e.g. by means of double adhesive tape, Velcro, an elastic substance, screws etc. In an embodiment intended for securing by means of screws the bottom is in two diametrically opposite corners furnished with a hole for a screw, where the hole can be surrounded by a circular wall in the pattern of stiffening ribs. This ensures a solid securing as the screws are offset relative to each other such that the risk of crack formations in the surface between the two screws are considerably lowered and also reduces the tendency to an unintended rotation of the operating unit.

In an embodiment, the underside of the bottom is furnished with a countersink for a screw head, such that the screw after mounting does not protrude into the housing, i.e. when the screw is correctly screwed in it is avoided that this will conflict with the electronics in the housing, just as it is avoided that the screws can interfere with the tilting of the housing.

In an embodiment, the bottom part of the housing has two holes surrounded by a round-going wall internally in the under part, and where the two holes are placed such that they, when assembled with the top portion with the mounting unit, are located opposite the screw holes in this. This eases the mounting of the operating unit as this can be mounted in its assembled state. Loose components which should be mounted afterwards are thus avoided.

The operating unit is mounted by placing this with the top side of the mounting unit against the surface on which the operating unit should be mounted. The operating unit is secured by screwing a screw through the hole in the housing intended for said purpose and through the hole in the mounting unit, and when screwing it into the surface on which the operating unit is mounted, the screw is guided through the housing until the screw rests with its head in the countersink on the mounting unit.

In an embodiment, the underside of the bottom of the mounting unit, integrated therewith, is furnished with a ridge with a through-going tubular passage for the shaft, and where the ridge runs across along the center of the bottom and from side edge to side edge of the mounting unit. In that the shaft runs in a through-going passage, which runs from one side to the other side of the mounting unit, a secure and stable mounting of the shaft is ensured. There is e.g. no risk of the shaft buckling, it remains rectilinear no matter what, and a possible crookedness of the shaft will correct itself during the mounting in the passage. This ridge with the tubular passage contributes to the strength of the mounting unit and so does the shaft, which has the benefit that the mounting unit moreover can be made relatively thin.

In an embodiment, between the side wall in the recess in the housing and the side wall in the upper part thereof there is also a pattern of stiffening ribs, and at each side of the upper part located opposite to each other in a center line of the recess there is a cylindrical hole for the shaft for the mounting unit, and whereby the cylindrical hole is provided in the side wall, which outlines the upper part and the side wall which outlines the recess as well as a strengthening for that purpose between the two side walls. This embodiment further contributes to a stable and secure mounting of the ends of the shaft in the upper part of the housing. The strengthening between the respective side walls also contributes to the strength of the edges of the upper part. In another embodiment the pivot shaft is constituted by two axle pins. Both in case of a through-going shaft and two axle pins the hinging can be constructed so that these shafts or these axle pins, respectively, can be guided sideways into the hinging through a recess. The width and shape of the recess as well as the shaft or the two axle pins, respectively, are adapted such that the shaft or the axle pins, respectively, by means of a snap effect are locked in the hinging. It is however noted that such a structure is relatively voluminous and that it of cause entails a risk that the shaft or the axle pins, respectively, as a result of hard and unintended impact can be ripped out of the hinging.

In an embodiment, the shaft is a through-going steel shaft, where the mounting unit is secured in the recess in the upper part, where the shaft is mounted, such that it runs from a side of the top part in the cylindrical hole for that purpose, through the cylindrical passage in the mounting unit and into the cylindrical hole in the other side of the upper part. Using a steel shaft makes it possible to make the construction of the operating unit relatively thin.

In an embodiment, the housing is mounted with its center of gravity in such a way relative to the shaft between the housing and the mounting unit that the housing as a result of the gravity will assume an initial position. This is a simple construction, but on the other hand it is necessary to be sure that the center of gravity corresponds to the housing otherwise the housing would spontaneously tilt to one side or the other. Further, the operating unit is typically connected to a controller by means of a cable, where the cable also affects the housing with a force, where the size and direction of the force among other things are dependent on how the cable is secured.

In an embodiment, the operating unit comprises at least one spring element, which impacts the housing with a spring force when this is brought into the activation position, and rotates the housing back into the initial position, when this is no longer impacted into the activation position. This is a relatively simple manner of ensuring that the housing assumes the initial position when it is not activated. Further, the housing is impacted by a spring force when this is pressed towards the activation position, which will give the user an assured feel, when he or she is operating the housing.

In an embodiment, the at least one switch is a dome switch, where the dome in the switch is used as a spring element. Thus, a separate spring element is avoided and with that the inconvenience of adapting the construction for integrating this in the housing. When mounting the dome switch this should merely be placed such that it is impacted when the operating unit is activated.

In an embodiment, two dome switches are arranged such that they are located on either side of the shaft, more precisely on either side of a plane through the shaft, where the plane is perpendicular to the housing. I.e. when the user wishes to make an adjustment one way, the housing is pressed in the upwards direction and when the housing should be adjusted the other way, the housing is pressed in the downwards direction.

Furthermore, when the operating unit is mounted, the housing assumes a neutral position, the initial position, as the two dome switches are located on either side of the pivot shaft. The spring force in the dome switches retains the housing in this position. By pressing the housing such that it tilts towards the surface on which the operating unit is mounted, the nearest dome switch will be pressed against the pin on the mounting unit such that this dome switch is activated. If the housing is released, this will due to the spring force in the dome switch be pressed away from this back into the initial position and thus the dome switch is no longer activated. Should the housing start to pendulate about the shaft when this is released, the spring constant in the dome switches is adapted such that these will not be activated, and the housing will subside. Moreover, the weight of the housing is so small that the forces with which the dome switches are impacted by a pendulation of the housing hardly in itself would be able to activate a dome switch. The activation requires a distinct pressure on the housing. When the housing is pressed away from the surface on which the operating unit is mounted, the second dome switch is activated in a corresponding manner as it is pressed against the other pin on the mounting unit.

A characteristic of dome switches is the rather blunt mode of operation which is owing to the resilient switch of the dome switch. In the invention this inexpedient blunt mode is avoided in that the housing functions as an arm, lever, which provides a larger migration and requires a smaller force when the switch is activated which results in a more comfortable operation. By simple means, a low-cost dome switch is thus transformed into a switch with a considerably more comfortable operation comfort.

In an embodiment, the mounting unit is mounted in the recess in the housing, such that it protrudes a distance over the top side of the housing and in case the recess is surrounded by a round-going side wall, also protrudes a distance over this. Thus, the housing of the operating unit will assume a position at a distance from the surface on which it is mounted, which eases the operation of the housing as there is room for the fingers between the housing and the surface on which the operating unit is mounted. If, for some reason, it is desired to place the operating unit completely below the surface on which the operating unit is mounted, this is also possible. E.g. in case of an adjustable table, it can be desirable to position the operating unit as far under the table top as possible, such that the user will not unintentionally come into contact with it, or it will not hit something when moving or switching around the furniture.

When activating the operating unit, it is important that the user experiences a back pressure when operating the housing, said back pressure should preferably increase the more the housing rotates about the shaft, but it is also important that the user does not unintentionally overload the operating unit by pressing too hard against the housing. In an embodiment, the recess across the shaft of the mounting part is slightly larger than the mounting element, but only so large that the edges of the recesses still function as mechanical stop for the housing when rotating this. It is thus prevented that the user unintentionally performs an excess pressure on the housing.

In an embodiment, the side walls on the top side of the upper part or the underside thereof, which outlines the recess across the shaft of the mounting part, is slightly larger than the mounting element, but only so large that the side walls either on the top side or the underside of the upper part function as mechanical stops for the housing when rotating this. The angle which the housing can rotate about the shaft is limited such that e.g. the dome switches are not destroyed by being pressed too hard against the pins on the mounting unit. This is achieved with an adaption of the width of the mounting unit and the width of the hole in the housing in the transversal direction on the shaft, the height of the mounting unit over the shaft and finally the height of the side wall, which surrounds the recess for the mounting unit, such that the side wall hits the mounting unit and thus prevents further rotation of the housing.

In an embodiment, the printed circuit board is mounted in the bottom part of the housing, where the printed circuit board in two diametrically opposite corners has a hole, such that the printed circuit board with these two holes are mounted over the circular walls of the screw holes. The printed circuit board is thus fixed in the bottom part and can further be fixed by means of a snap, which grips over the printed circuit board. The snap can be constructed as a round-going edge at the top of the circular walls for the screw holes or in the side wall of the housing. The printed circuit board can rest on a rib pattern in the bottom part. Thus, an easy and stable mounting of the printed circuit board is ensured.

In an embodiment, the two dome switches are located in the two diametrically located corners opposite to the holes for the mounting and are located such that they are positioned across from the pins in the mounting unit. When the top part and bottom part of the housing are assembled the two pins on the mounting unit will be located across from the dome switches. By pressing the housing, one or the other dome switch will, as described above, be pressed upwards against the pin intended for that purpose on the mounting unit. The chosen placement ensures a good and stable mounting of the dome switches as the screws for the mounting are located in the two other diametrically located corners.

In an embodiment, a front part of the housing describes an angle with the rest of the housing such that this front part faces away from the surface, upon which the operating unit is mounted. Above all, this embodiment makes it easy to activate the operating unit as the slanting part appears as a grip. Further, the slanting embodiment enables the housing of the operating unit to be placed fairly close up against the surface, as the slanting part of the housing faces away from the surface and thus provides good access for operating it.

In an embodiment, the front part of the housing is furnished with further operating switches and/or light indicator and/or display. This could be switches used for recalling information, e.g. information on the specific users, where the piece of furniture adjusts itself automatically after the specific user. The display can show various information such as the adjustment of the piece of furniture, and light indicators can be used as a reminder for when it is time to change the adjustment of the piece of furniture.

The invention further relates to an actuator system comprising at least one lifting column or actuator driven by an electric motor, as well as a control unit connected to the lifting column or the actuator driven by the electric motor, as well as an electrical operating unit as described above, which is connected to the control unit, such that the lifting column or the actuator driven by the electric motor can be activated via the electrical operating unit.

The invention further relates to a height-adjustable table comprising at least a table top and an actuator system as described above. Thus, the user can adjust the height of the table top by activating the electrical operating unit.

In an embodiment of the height-adjustable table, the operating unit is mounted on an underside of the table top at an edge thereof.

In an embodiment of the height-adjustable table, the edge of the table top is, at least locally, where the operating unit is mounted, beveled towards an underside of the table top. All things being equal, this beveling provides more room for operating the operating unit.

BRIEF DESCRIPTION OF THE DRAWINGS

The invention will be described more fully below with reference to embodiment of an operating unit shown in the accompanying drawing.

The drawing shows.

DETAILED DESCRIPTION OF EMBODIMENTS

Figure 1:
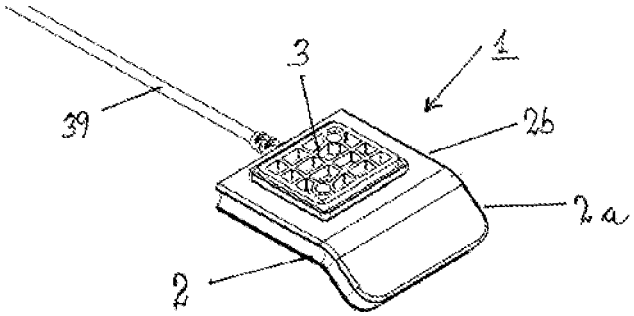
FIG. 1, an operating unit shown in perspective seen from the front and from above, FIG. 2, the operating unit shown in perspective from the rear side and from below, FIG. 3, the operating unit shown directly from the side, while in the resting position, FIG. 4, a cross-section through the operating unit, while in the resting position, FIG. 5, the same as FIG. 4, but where the operating unit is activated for raising the table top, FIG. 6, the same as FIG. 5, but where the operating unit is activated for lowering the table top, FIG. 7, an exploded view of the operating unit shown in perspective from the front and from above, FIG. 8, an exploded view of the operating unit shown in perspective from the front and from below, and FIG. 9, an outline of a desk.
Figure 2:
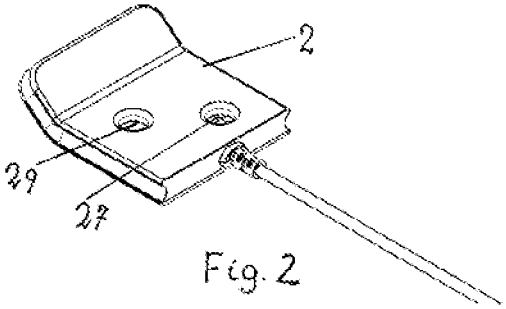
Figure 3:
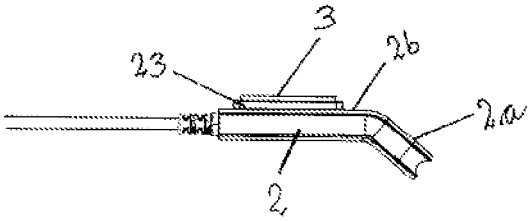

As it appears from the drawing, the operating unit 1 comprises a first part 2 constructed as a housing, which contains the necessary electronics for the function of the operating unit, and a second part constructed as a mounting unit 3, where the mounting unit is constructed as a flat box-shaped block with round-going side edge 4 and plane bottom 5 and where the inside of the block is furnished with a pattern of stiffening ribs 6. In two opposite corners of the bottom 5 there is a hole 7,8 for a screw, where the hole is surrounded by a ring-shaped wall 9,10 in the pattern of stiffening ribs 6. A countersink 11,12 for a screw head is supplied at the bottom 5, such that the screw after mounting does not protrude into the housing 2. In the two opposite corners of the screw holes 7,8 the underside of the bottom 5 is furnished with two pins 13,14, the function of which will be mentioned below. On the underside of the bottom 5, integral therewith, a transverse ridge 15 with a through-going tubular passage 16 for a shaft 17 is provided. The ridge 15 runs across along the center of the bottom 5 and from side edge to side edge of the mounting unit 3.

The housing 2 consists of two parts, an upper part 18 with a round-going side wall 19 and a bottom part 20 also with a round-going side wall 21. The contour of the two side walls 19,21 corresponds to each other, such that they may be joined together. The upper part 18 is furnished with a recess 22 for the mounting unit 3. The recess 22 is restricted by a side wall 23, which both protrudes a distance into the housing 2 as well as a distance up from the housing 2. In that the side wall 23 protrudes a distance up from the housing 2 it, among other things, serves the purpose of preventing dirt and possibly liquid from cleaning or spilled fluid, such as coffee or tea, from seeking into the recess 22. Between the side wall 23 in the recess 22 and the side wall 19 in the upper part 18 there is likewise a pattern of stiffening ribs 24. At each side of the upper part 18 located opposite to each other in a center line of the recess 22, there is a cylindrical hole 25 for the shaft 17 for the mounting unit 3. The cylindrical hole 25 is provided in the side wall 19, which outlines the upper part 18 and the side wall 23 which outlines the recess 22 as well as a strengthening 26 for that purpose between the two side walls. The mounting unit 3 is secured in the recess 22 of the upper part by placing this in the recess such that the shaft 17, from one side of the upper part 18, can be inserted into the cylindrical hole 25, through the cylindrical passage 16 in the mounting unit 3 and into the cylindrical hole 25' in the other side of the upper part 18. The mounting unit 3 is positioned such that its bottom 5 with the two pins 13,14 will protrude into the housing 2.

The bottom part 20 of the housing is furnished with two holes 27,29, which internally in the bottom part 20 is surrounded by a round-going edge 28,30. The two holes 27,29 are placed such that they during the assembly of the bottom part 20 with the upper part 18, in which the mounting unit 3 is inserted, is located across from the screw holes 7,8 in this.

In the bottom part 20 of the housing, a printed circuit board 31 is mounted, where there in two opposite corners of the printed circuit board is a hole 32,33, such that the printed circuit board with these two holes can be mounted over the round-going edges 28,30 on the screw holes 27,29, and such that the printed circuit board will rest on a rib pattern in the bottom part 20. The printed circuit board 31 is thus fixed in the bottom part 20 and can further be fixed by means of a snap, which grips over the printed circuit board. In the two other diametrically located corners of the printed circuit board 31 two dome switches 34,35 are located. When the top part 18 and the bottom part 20 of the housing are assembled, the two pins 13,14 on the mounting unit 3 will be located across from the dome switches 34,35.

An end, the front end 2*a*, of the housing 2, is beveled relative to the rest of the housing which is plane 2*b*. The slanting front end 2*a* of the housing is intended as a handle for activating the operating unit. The beveled front end 2*a* of the housing is designed such that is faces away from the side, where the mounting unit 3 is mounted. When the operating unit is mounted on a surface, the beveled front end 2*a* of the housing will thus face away from the surface and thus making it more accessible for operation.

The operating unit 1 is mounted by placing it with the top side of the mounting unit 3 against the surface upon which the operating unit should be mounted. The operating unit is secured by screwing a screw through the hole 27,29 in the housing 2 intended for that purpose and through the hole 7,8 in the mounting unit 3 and when screwing it into the surface on which the operating unit is mounted, the screw is guided through the housing 1 until the screw rests with its head in the countersink 11,12 on the mounting unit 3.

When the operating unit is mounted, the housing 2 assumes a neutral position, initial position, as the two dome switches 34,35 are located on either side of the pivot shaft 17. The spring force in the dome switches 34,35 retains the housing 2 in this position. By pressing the housing 2, the underside of the beveling front end, the handle 2*a*, such that it tilts towards the surface on which the operating unit is mounted, the nearest dome switch 34 will be pressed against the pin 13 on the mounting unit 3 thus activating this dome switch. If the housing 2 is released, this will due to the spring force in the dome switch 34 be pressed away from this back into the initial position and thus the dome switch is no longer activated. Should the housing 2 start to pendulate about the shaft 17 when this is released, the spring constant in the dome switches 34,35 is adapted such that these will not be activated and the housing 2 will immediately subside. The activation required a distinct pressure on the housing 2. When the housing 2 is pressed away from the surface on which the operating unit 1 is mounted, the second dome switch 35 is activated in a corresponding manner as it is pressed against the other pin 14 on the mounting unit.

The angle which the housing 2 can rotate about the shaft 17 is limited such that the dome switches 34,35 are not destroyed by being pressed too hard against the pins 13,14 on the mounting unit 3. This is achieved with an adaption of the width of the mounting unit 3 and the width of the hole 22 in the housing 2 in the transversal direction on the shaft 17, the height of the mounting unit 3 over the shaft and finally the height of the side wall 23, which surrounds the recess 22 for the mounting unit 3, such that the side wall 23 hits the mounting unit 3 and thus prevents further rotation of the housing 2.

Figure 4:
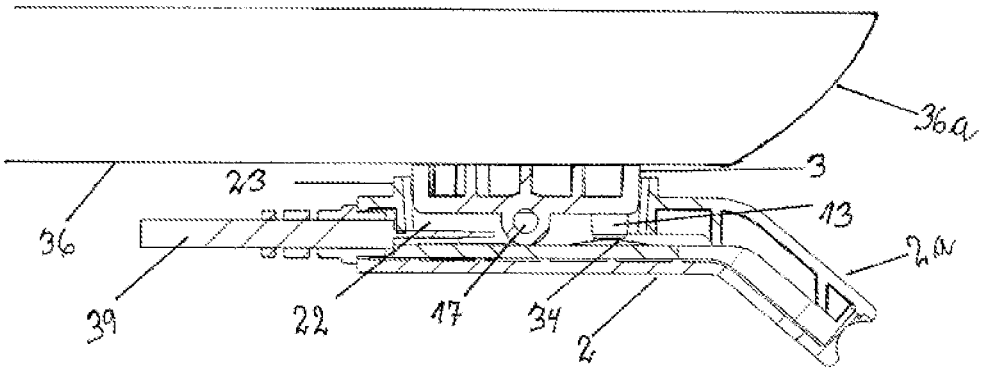
Figure 5:
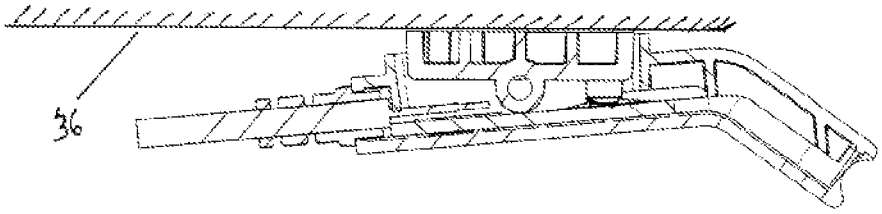
Figure 6:
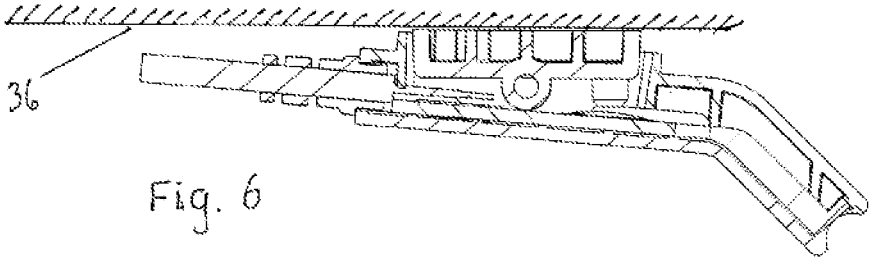
Figure 7:
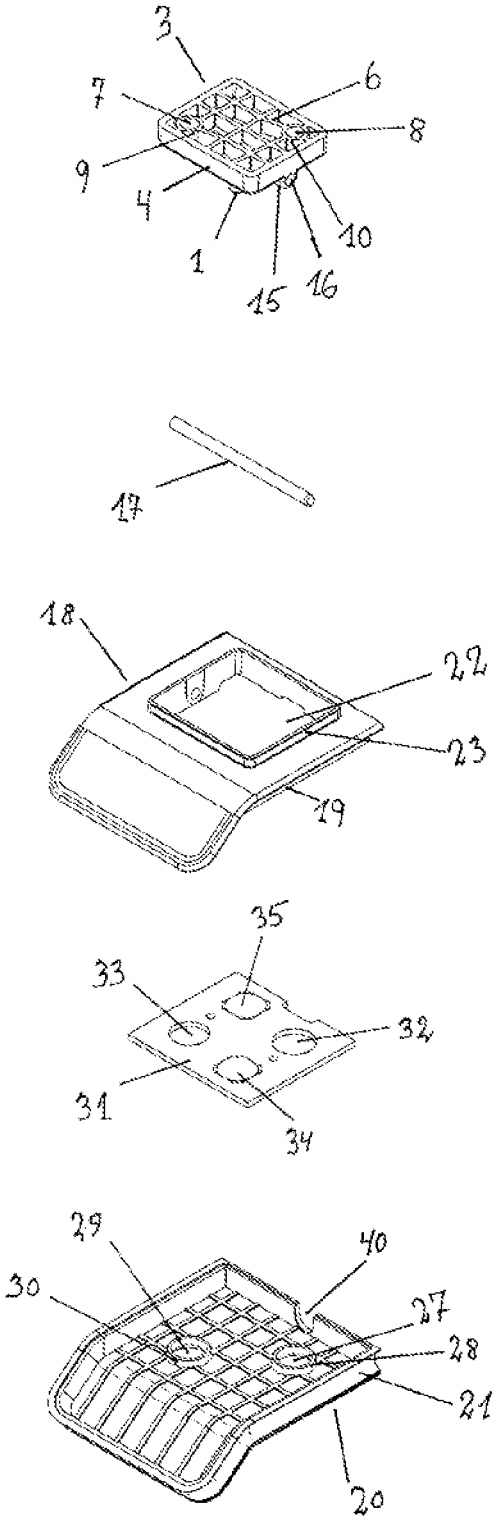
Figure 8:
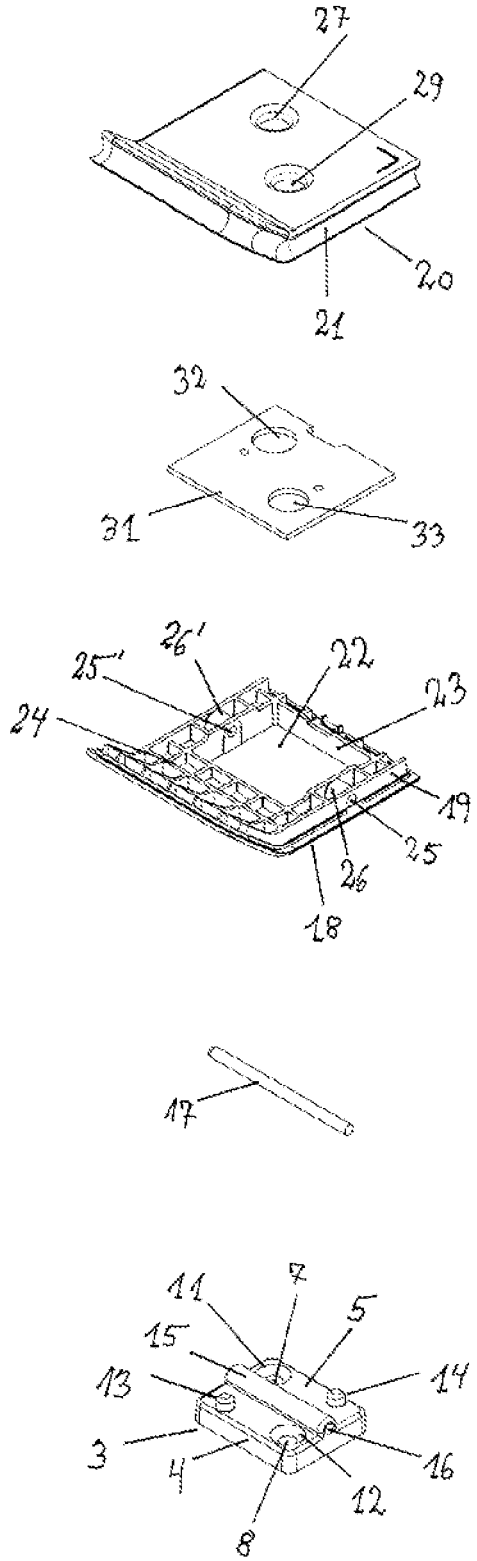
Figure 9:
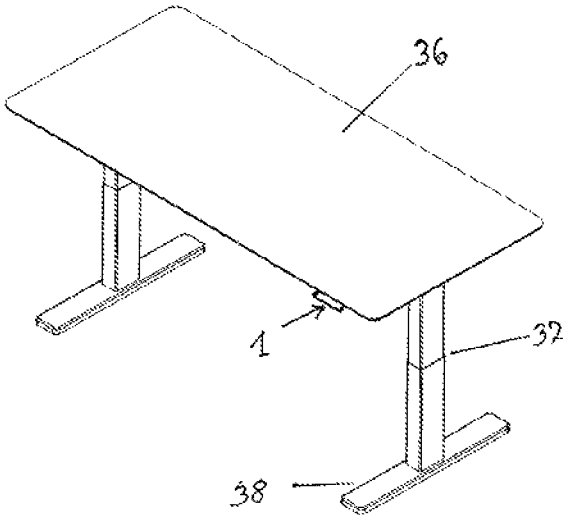

FIG. 9 of the drawing shows an outline of a height-adjustable desk, also known as a sit/stand desk, with a table top 36 mounted on a subframe, which in each side comprises a lifting column 37 with a foot 38. Such lifting columns constructed as table legs are now well-known and comprise a telescopic guide and a drive unit, which can be a spindle unit driven by an electric motor, alternatively an endless chain or rim-based drive unit likewise driven by an electric motor. When the chain/rim is brought into motion, two rods will displace the telescopic guide outwards or retract it depending on the direction of rotation of the electric motor. The subframe of the height-adjustable table can, in a different embodiment, be equipped with two lifting columns driven by a single electric motor, where each lifting column is connected to the electric motor through a transmission. The drive units are typically connected to a control box containing a controller and a power supply. It is commonly used to connect the operating unit to the control box with a wire, alternatively by means of a wireless connection, whereby the cable is eliminated. With a wireless connection the operation unit will on the other hand have to contain a power supply, which could be a battery. In an embodiment of the operating unit according to the invention, a cable 39 is guided through a recess 40 in the wall 21 of the bottom part 20. The cable 39 can be directly connected to the electric equipment, such as the printed circuit board 31, or the cable 39 can be equipped with a plug for inserting into a socket in the recess 40 in the wall 21 of the bottom part 20 of the housing 2. In both cases the insertion of the cable 39 is limited to an incision in the bottom part of the housing 2 for the operating unit. The lifting columns 37 can be mutually connected with a frame, on which the table top 36 rests, or the lifting columns 37 can be designed such that they are mounted directly onto the underside of the table top 36. At the front edge of the table top 36, i.e. the side of the table where a user is situated, an operating unit 1 for the two lifting columns 37 is mounted. In FIGS. 4-6 of the drawing, the table top 36 is indicated and in FIG. 4 a beveling of the front edge of the table top 36*a* is shown. A beveled front end, handle 2*a*, on the operating unit 1 and the beveled front edge 36*a* of the table top 36, which is beveled in the opposite direction to the front end 2*a* of the operating unit 1, ensures a relatively large clearance for operating the operating unit 1 even though the operating unit is positioned entirely or partly under the table top 36 up against the front edge 36*a* thereof. A table top 36 will usually have a uniform edge, which runs all the way around the table top, but in case of a sharp front edge a section can be made with a beveling, which at the same time indicates, where the operating unit 1 should be mounted.

As mentioned above, the front part, the handle 2*a*, of the housing 2 can be furnished with further operating switches, e.g. placed in the front edge constituted by the two round-going sides 19,21 on the upper and bottom part of the housing. In the surface on the top side of the handle 2*a* a display can be mounted and at the edge light indicators can be built-in. This could, as mentioned above, be switches used for recalling information, e.g. information on the specific users, where the piece of furniture adjusts itself automatically after the specific user. The display can show various information such as the adjustment of the piece of furniture, and light indicators can be used as a reminder for when it is time to change the adjustment of the piece of furniture.

The invention thus provides a simple and easy to mount operating unit.

Even though the invention here especially is described in connection with height-adjustable tables, it is understood that the operating unit can of cause be used in connection with other types of furniture. The operating unit is intended mounted such that the pivot shaft is horizontal, but it is understood that it of cause can also be mounted with the pivot shaft in vertical position.

What is claimed is:

1. An electrical operating unit comprising:

a housing, the housing comprising an upper part and a lower part;

a mounting unit mounted into a recess formed in one of the upper part or lower part of the housing, the mounting unit being connected to the housing, with the housing being configured to rotate about an axis with respect to the mounting unit; and at least one electrical switch, wherein the housing and the mounting unit can be mutually adjusted, and wherein the housing can assume a first position, an initial position, from which the housing by rotation about the axis can be brought to a second position, an activation position, where the switch is activated.

2. The electrical operating unit according to claim 1 wherein the side of the mounting unit which faces towards or protrudes into the housing, is furnished with a pin for activation of the at least one electrical switch.

3. The electrical operating unit according to claim 1, further comprising at least one spring element, the spring element configured to impact the housing with a spring force when the housing is brought into the activation position, and rotate the housing back into the initial position, when the housing is no longer being impacted into the activation position.

4. The electrical operating unit according to claim 3, wherein the at least one electrical switch is a dome switch, where the dome in the switch is used as the spring element.

5. The electrical operating unit according to claim 4, wherein there are two dome switches arranged such that they are located on opposite sides of the rotation axis of the housing.

6. The electrical operating unit according to claim 5, wherein the two dome switches are located on two diametrically opposite corners of a printed circuit board disposed in the housing, and the mounting unit comprises two pins located across from the two dome switches when the mounting unit is mounted in the recess of the housing.

7. The electrical operating unit according to claim 1, wherein the mounting unit is mounted in the recess in the housing such that it protrudes a distance over the top side of the housing.

8. The electrical operating unit according to claim 7, wherein the recess is surrounded by a round-going side wall and the mounting unit also protrudes a distance over the round-going side wall.

9. The electrical operating unit according to claim 1, wherein the recess of the upper part or the lower part of the housing is slightly larger than the mounting element in a direction perpendicular to the rotation axis of the housing, but only so large that the edges of the recess still function as mechanical stops for the mounting unit when the housing rotates about the axis.

10. The electrical operating unit according to claim 1, wherein a frontmost portion of the housing constitutes an angle with the remaining part of the housing such that this frontmost portion faces away from the surface on which the operating unit is mounted.

11. An actuator system comprising at least one lifting column or actuator driven by an electric motor, and a control unit connected to the lifting column or the actuator driven by the electric motor wherein the actuator system comprises an electrical operating unit according to claim 1 connected to the control unit, and where the lifting column or the actuator driven by an electric motor can be activated through the electrical operating unit.

12. A height-adjustable table comprising an actuator system according to claim 11.

13. The height-adjustable table according to claim 12, further comprising a tabletop and where the electrical operation unit is mounted on an underside of the tabletop at an edge thereof.

* * * * *